US009702142B1

(12) United States Patent
Wang et al.

(10) Patent No.: US 9,702,142 B1
(45) Date of Patent: Jul. 11, 2017

(54) WATER STAIN AND SAG RESISTANT ACOUSTIC BUILDING PANEL

(71) Applicant: ARMSTRONG WORLD INDUSTRIES, INC., Lancaster, PA (US)

(72) Inventors: Michelle X Wang, Lititz, PA (US); Joanne Lefever, Lancaster, PA (US); Lida Lu, Lancaster, PA (US)

(73) Assignee: AWI Licensing LLC, Wilmington, DE (US)

( * ) Notice: Subject to any disclaimer, the term of this patent is extended or adjusted under 35 U.S.C. 154(b) by 0 days.

(21) Appl. No.: 15/140,266

(22) Filed: Apr. 27, 2016

(51) Int. Cl.

| | |
|---|---|
| ***E04B 9/04*** | (2006.01) |
| ***E04B 1/84*** | (2006.01) |
| *E04B 9/06* | (2006.01) |
| *E04B 1/74* | (2006.01) |

(52) U.S. Cl.
CPC ..... *E04B 1/8409* (2013.01); *E04B 9/045* (2013.01); *E04B 9/0435* (2013.01); *E04B 9/067* (2013.01); *E04B 2001/742* (2013.01)

(58) Field of Classification Search
CPC ..... E04B 9/045; E04B 9/0435; E04B 9/067; E04B 1/8409; E04B 2001/742
USPC ..... 181/286, 290, 291, 294
See application file for complete search history.

(56) References Cited

U.S. PATENT DOCUMENTS

| | | | | |
|---|---|---|---|---|
| 3,103,444 | A * | 9/1963 | Cotts | C04B 26/285 106/211.1 |
| 4,804,572 | A | 2/1989 | Bodrogi | |
| 6,068,907 | A | 5/2000 | Beauregard | |
| 6,221,464 | B1 | 4/2001 | Patel et al. | |
| 6,869,680 | B2 | 3/2005 | Belmares et al. | |
| 6,905,563 | B2 | 6/2005 | Dong et al. | |
| 7,060,155 | B2 | 6/2006 | Dong et al. | |
| 7,368,150 | B2 | 5/2008 | Pritchett | |
| 2003/0124330 | A1 | 7/2003 | Belmares et al. | |
| 2004/0231916 | A1* | 11/2004 | Englert | B28B 5/027 181/296 |
| 2010/0016151 | A1* | 1/2010 | Caldwell | B01D 53/72 502/401 |
| 2010/0256293 | A1* | 10/2010 | Lu | C08J 3/24 524/549 |
| 2010/0320029 | A1* | 12/2010 | Cao | E04B 9/001 181/286 |
| 2012/0156471 | A1* | 6/2012 | Lu | E04C 2/16 428/324 |
| 2013/0196151 | A1 | 8/2013 | Saghbini | |

FOREIGN PATENT DOCUMENTS

| | | |
|---|---|---|
| AR | 078679 | 11/2011 |
| CN | 2272471 | 1/1998 |
| TW | 201217620 | 5/2012 |
| WO | 2008143377 | 11/2008 |

* cited by examiner

*Primary Examiner* — Jeremy Luks
(74) *Attorney, Agent, or Firm* — Craig M. Sterner

(57) ABSTRACT

Described herein is an stain and sag resistant acoustic ceiling panel comprising a porous body formed from mineral and cellulosic fibers having an upper surface opposite a lower surface and at least one side surface extending between the upper surface and the lower surface; a first layer applied to the upper surface, the first layer comprising a hygroscopic component and a hydrophobic component; and a second layer applied to the lower surface, the second layer comprising a hydrophobic component.

15 Claims, 8 Drawing Sheets

WATER STAIN AND SAG RESISTANT ACOUSTIC BUILDING PANEL

BACKGROUND

Building panels—specifically water pervious ceiling panels—have a tendency to become stained when exposed to water. Water may contact a building panel in the form of droplets that originate from condensation or a leak on pipes and ductwork that are located in the space above the ceiling. The water can drip onto the backside of the building panel and migrate to the visible appearance side of a panel. Staining can occur because the water can carry off contaminants from surfaces it contacts and, often, because the water droplets migrate through the building panel and leach tannin from recycled newsprint or other plant based cellulose materials, as well as inorganic staining agents, from other components used in the tile composition bringing such staining agents to the front surface of the panel.

Previous attempts at preventing the formation of stains in building panels included adding a back coating to the building panel. However, such previous attempts provide only temporary resistance to staining as water can still migrate through other areas of the building panel resulting in the need for premature replacement of the ceiling panel before reaching the fully the intended life-span of the building panel. These previous attempts also fail to address the substantial risk of sagging within the body of building panel after being exposed to water from one or more leaks and/or condensation. Thus, there exists a need for an improved stain-resistant building panel that can extend the life-span of the building panel by prolonging the formation of stains on a building panel after exposure to water as well as exhibit superior sag resistance after being exposed to water.

BRIEF SUMMARY

The present invention is directed to an acoustic ceiling panel comprising: a porous body having an upper surface opposite a lower surface and at least one side surface extending between the upper surface and the lower surface; a first layer applied to the upper surface, the first layer comprising a hygroscopic component; and a second layer applied to the lower surface, the second layer comprising a first hydrophobic component.

Other embodiments of the present invention include an acoustic ceiling panel comprising a porous body having an upper surface opposite a lower surface, the porous body comprising a stain-repellant material comprising a fibrous material coated with a first hydrophobic component, wherein the first hydrophobic component is present in an amount of at least about 1.5 wt. % based on the total weight of the stain-repellant material.

Other embodiments of the present invention include a ceiling system comprising: a ceiling support grid; at least one ceiling panel supported by the ceiling support grid, the ceiling panel having a first major surface opposite a second major surface, the second major surface facing upward and the first major surface facing downward; wherein under atmospheric pressure the ceiling panel is configured to: (1) allow air and water in vapor phase to pass through the ceiling panel between the first major surface and the second major surface; and (2) prevent water in the liquid phase from flowing through the ceiling panel from the second major surface to the first major surface under gravitational pull.

Other embodiments of the present invention include a method of manufacturing an acoustic ceiling panel comprising: forming a porous body having an upper surface opposite a lower surface and a side surface extending between the upper surface and the lower surface; applying a first coating to the upper surface and second coating to the lower surface; wherein the first coating comprises a hygroscopic component and the second coating comprises a first hydrophobic component.

Other embodiments of the present invention include a method of manufacturing an acoustic ceiling panel comprising: forming a slurry of water, fibers, binder, and wax; moving the slurry over a porous web to form a wet-state body; and drying the wet-state body at an elevated temperature, thereby driving off the water to form a dry-state body; wherein the wax is present in an amount ranging from about 1 wt. % to about 4 wt. % based on the total weight of the dry-state body.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
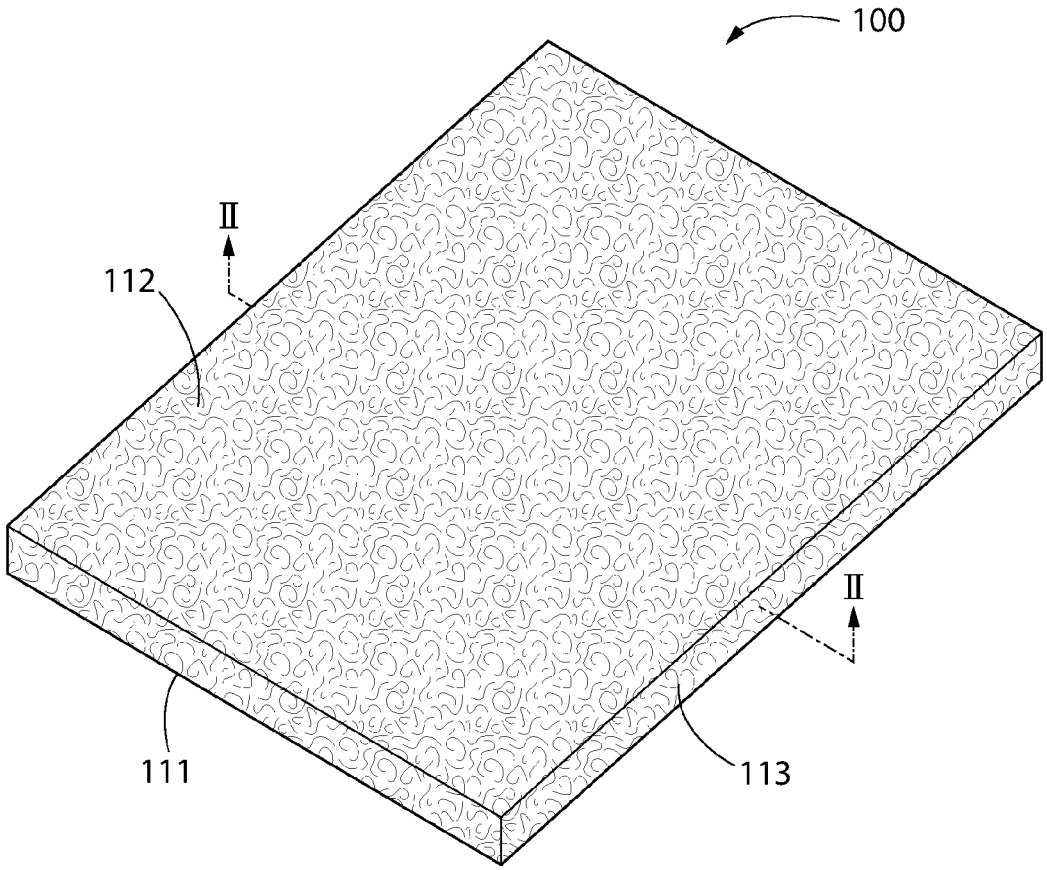
FIG. 1 is top perspective view of a building panel according to the present invention.

The following description of the preferred embodiment(s) is merely exemplary in nature and is in no way intended to limit the invention, its application, or uses.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

Unless otherwise specified, all percentages and amounts expressed herein and elsewhere in the specification should be understood to refer to percentages by weight. The amounts given are based on the active weight of the material.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top," and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such.

Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

Unless otherwise specified, all percentages and amounts expressed herein and elsewhere in the specification should be understood to refer to percentages by weight. The amounts given are based on the active weight of the material. According to the present application, the term "about" means+/−5% of the reference value. According to the present application, the term "substantially free" less than about 0.1 wt. % based on the total of the referenced value.

Referring to FIG. 1, the building panel 100 of the present invention may comprise a first major surface 111 opposite a second major surface 112. The ceiling panel 100 may further comprise a side surface 113 that extends between the first major surface 111 and the second major surface 112, thereby defining a perimeter of the ceiling panel 100.

Figure 7:
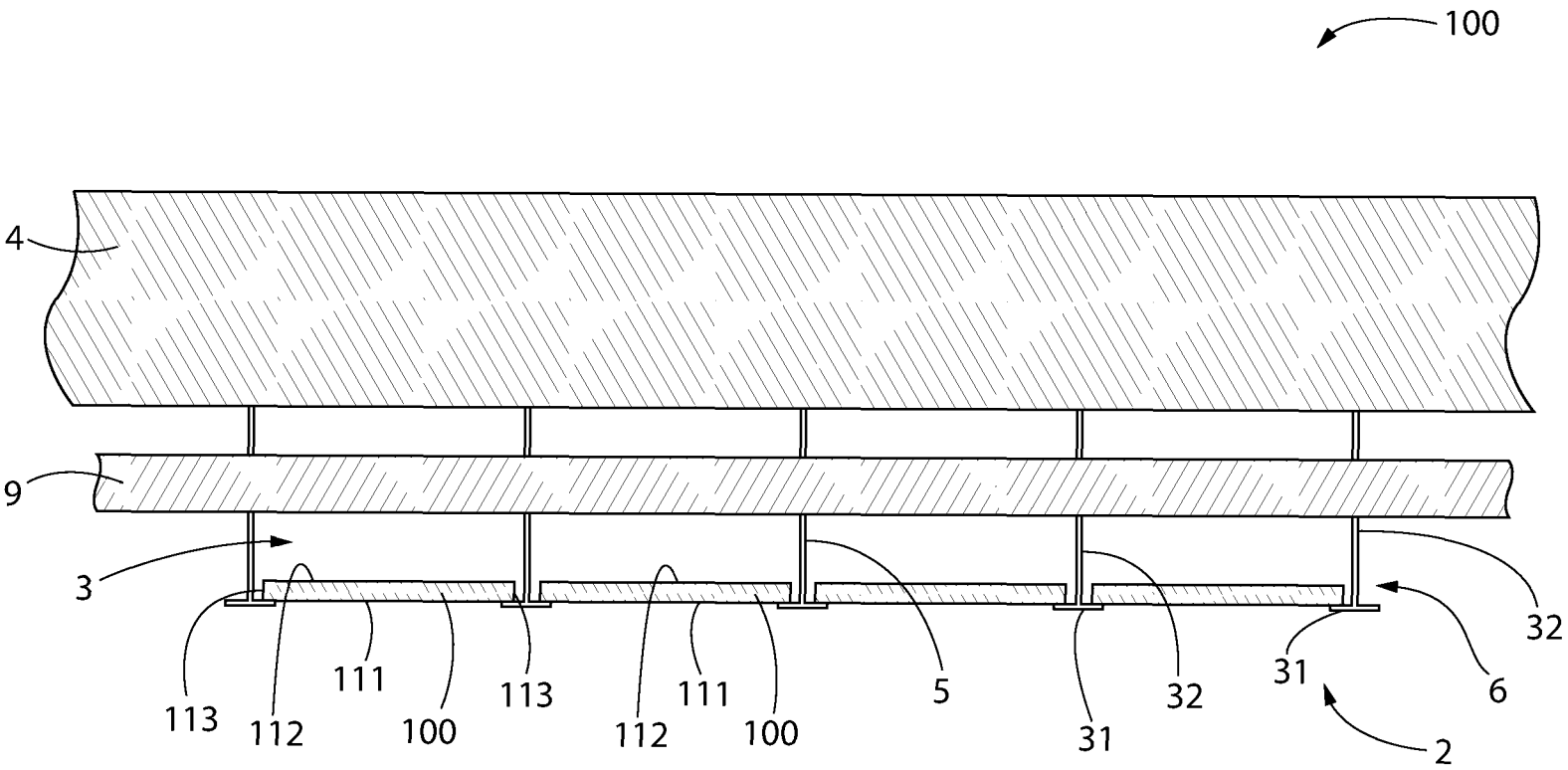
FIG. 7 is a ceiling system comprising the building panel of the present invention.
Figure 8:
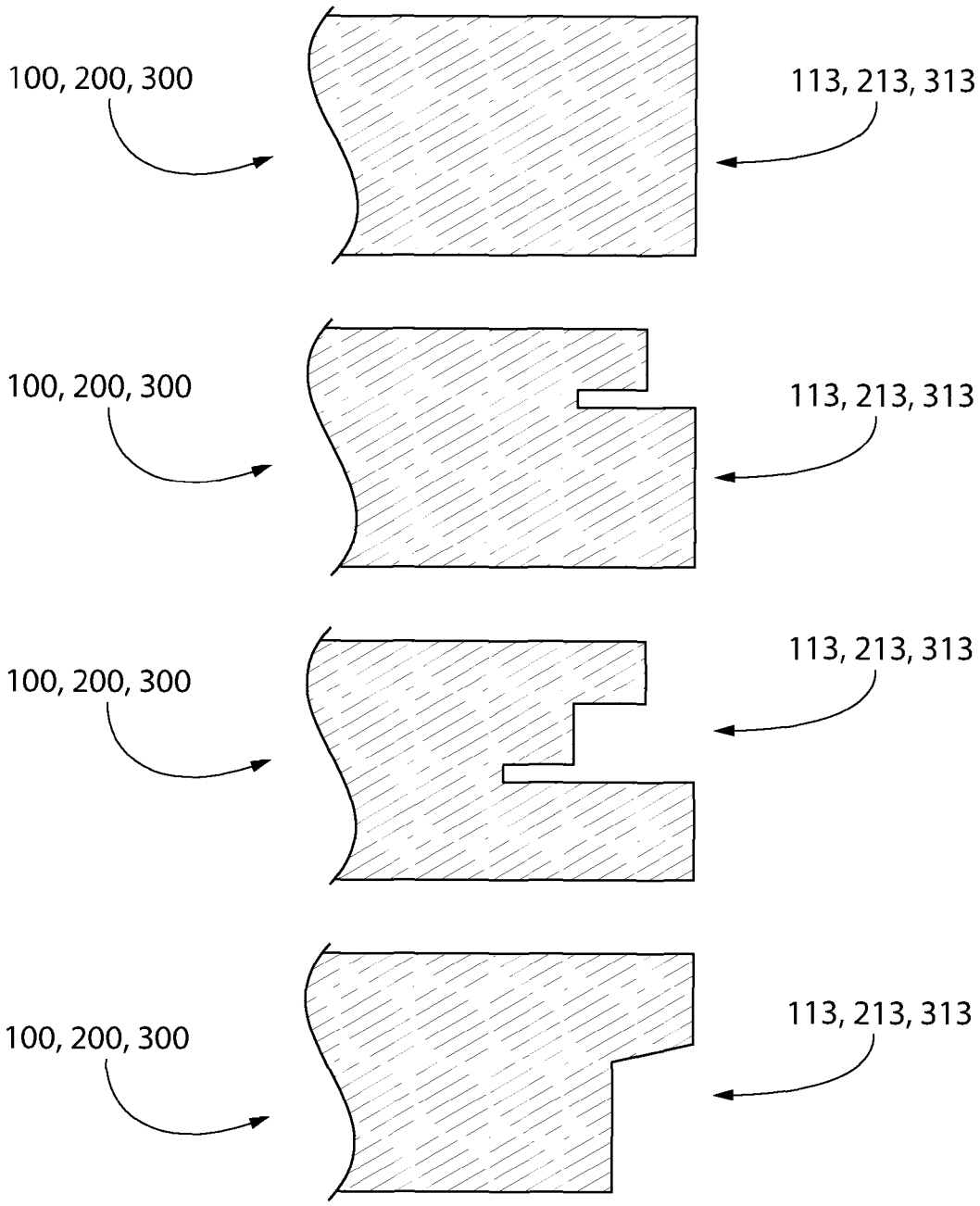
FIG. 8 is a cross-sectional close-up view of the edges of the building panels according to the present invention.

Referring to FIG. 7, the present invention may further include a ceiling system 1 comprising one or more of the building panels 100 installed in an interior space, whereby the interior space comprises a plenary space 3 and an active room environment 2. The plenary space 3 provides space for mechanical lines 9 within a building (e.g., HVAC, plumbing, etc.). The active space 2 provides room for the building occupants during normal intended use of the building (e.g., in an office building, the active space would be occupied by offices containing computers, lamps, etc.).

In the installed state, the building panels 100 may be supported in the interior space by one or more parallel support struts 5. Each of the support struts 5 may comprise an inverted T-bar having a horizontal flange 31 and a vertical web 32. The ceiling system 1 may further comprise a plurality of first struts that are substantially parallel to each other and a plurality of second struts that are substantially perpendicular to the first struts (not pictured). In some embodiments, the plurality of second struts intersects the plurality of first struts to create an intersecting ceiling support grid 6. The plenary space 3 exists above the ceiling support grid and the active room environment 2 exists below the ceiling support grid 6.

In the installed state, the first major surface 111 of the building panel 100 faces the active room environment 2 and the second major surface 112 of the building panel 100 faces the plenary space 3. The building panels 100 of the present invention have superior stain and sag resistance without sacrificing the desired airflow properties required for the building panels 100 to functional as acoustical ceiling tiles—as discussed further herein.

The ceiling system 1 of the present invention may include the ceiling support grid 6 and at least one building panel 100 supported by the ceiling support grid, the building panel 100 having the first major surface 111 opposite the second major surface 112, and the second major surface 112 facing upward and the first major surface 111 facing downward. Under atmospheric pressure (1 atm) the building panel 100 is configured to: (1) allow air and water in the vapor phase to pass through the ceiling panel 100 between the first major surface 111 and the second major surface 112, and (2) prevent water in the liquid phase from flowing through the building panel 100 from the second major surface 112 to the first major surface 11 under gravitational pull.

The term "liquid phase" refers to water being in the liquid phase under atmospheric pressure (1 atm) at room temperature (about 23° C.)—as referred to as "liquid water." The term "vapor phase" refers to air or water being in the gaseous phase under atmospheric pressure (1 atm) at room temperature (about 23° C.)—wherein water in the vapor phase may be referred to as "water vapor."

Figure 2:
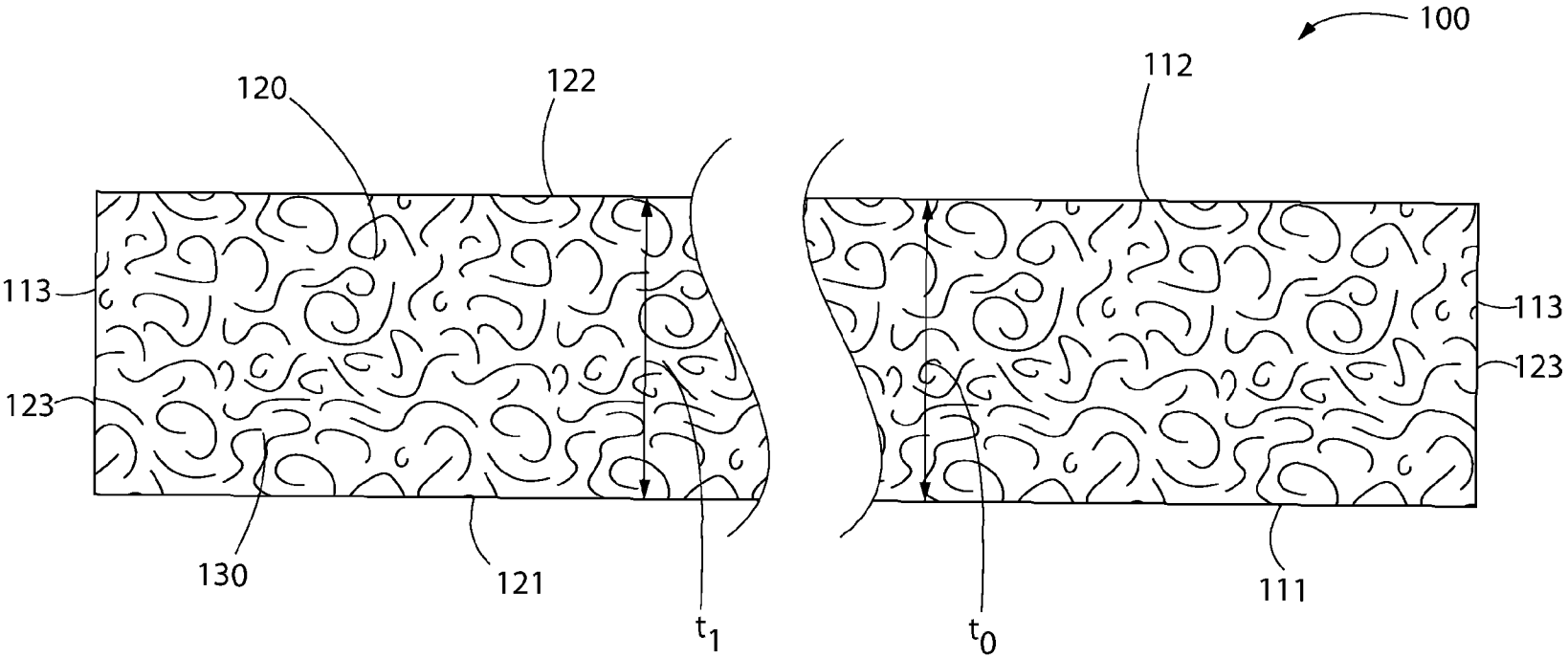
FIG. 2 is a cross-sectional view of the building panel according to the present invention, the cross-sectional view being along the II line set forth in FIG. 1.

Referring now to FIGS. 1 and 2, the building panel 100 of the present invention may have a panel thickness $t_0$ as measured from the first major surface 111 to the second major surface 112. The panel thickness $t_0$ may range from about 12 mm to about 40 mm—including all values and sub-ranges there-between. The building panel 100 may have a length ranging from about 30 cm to about 310 cm—including all values and sub-ranges there-between. The building panel 100 may have a width ranging from about 10 cm to about 125 cm—including all values and sub-ranges there-between.

The building panel 100 may comprise a body 120 having an upper surface 122 opposite a lower surface 121 and a body side surface 123 that extends between the upper surface 122 and the lower surface 121, thereby defining a perimeter of the body 120. The body 120 may have a body thickness $t_1$ that extends from the upper surface 122 to the lower surface 121. The body thickness $t_1$ may range from about 12 mm to about 40 mm—including all values and sub-ranges there-between.

The first major surface 111 of the building panel 100 may comprise the lower surface 121 of the body 120. The second major surface 112 of the building panel 100 may comprise the upper surface 122 of the body 120. When the first major surface 111 of the building panel 100 comprises the lower surface 121 of the body 120 and the second major surface 112 of the building panel 100 comprises the upper surface 122 of the body 120, the panel thickness $t_0$ is substantially equal to the body thickness $t_1$.

The body 120 may be porous, thereby allowing airflow through the body 120 between the upper surface 122 and the lower surface 121—as discussed further herein. The body 120 may be comprised of a binder and fibers 130. In some embodiments, the body 120 may further comprise a filler and/or additive. The body 120 may be treated with a hydrophobic component thereby rending the body 120 stain-repellant—as discussed further herein. According to the present invention, the term "hydrophobic" means a composition that is extremely difficult to wet and is capable of repelling liquid water under atmospheric conditions. Thus, as used herein, the term "hydrophobic" refers to a surface that generates a contact angle of greater than 90° with a reference liquid (i.e. water).

The notion of using the contact angle made by a droplet of liquid on a surface of a solid substrate as a quantitative measure of the wetting ability of the particular solid has also long been well understood. Wetting is the ability of a liquid to maintain contact with a solid surface, resulting from intermolecular interactions when the two are brought together. The degree of wetting (wettability) is determined by a force balance between adhesive and cohesive forces. If the contact angle is greater than 90° for the water droplet to the substrate surface then it is usually considered to be hydrophobic. For example, there are materials on which liquid droplets have high contact angles, such as water on paraffin, for which there is a contact angle of about 107°.

Non-limiting examples of binder may include a starch-based polymer, polyvinyl alcohol (PVOH), a latex, polysaccharide polymers, cellulosic polymers, protein solution polymers, an acrylic polymer, polymaleic anhydride, epoxy resins, or a combination of two or more thereof.

The binder may be present in an amount ranging from about 1 wt. % to about 25 wt. % based on the total dry weight of the body 120—including all values and sub-ranges there-between. The phrase "dry-weight" refers to the weight of a referenced component without the weight of any carrier. Thus, when calculating the weight percentages of components in the dry-state, the calculation should be based solely on the solid components (e.g., binder, filler, hydrophobic component, fibers, etc.) and should exclude any amount of residual carrier (e.g., water, VOC solvent) that may still be present from a wet-state, which will be discussed further herein. According to the present invention, the phrase "dry-state" may also be used to indicate a component that is substantially free of a carrier, as compared to the term "wet-state," which refers to that component still containing various amounts of carrier—as discussed further herein.

Non-limiting examples of filler may include powders of calcium carbonate, including limestone, titanium dioxide, sand, barium sulfate, clay, mica, dolomite, silica, talc, perlite, polymers, gypsum, wollastonite, expanded-perlite, calcite, aluminum trihydrate, pigments, zinc oxide, or zinc sulfate. The filler may be present in an amount ranging from about 25 wt. % to about 99 wt. % based on the total dry weight of the body 120—including all values and sub-ranges there-between.

Non-limiting examples of additive include defoamers, wetting agents, biocides, dispersing agents, flame retardants, and the like. The additive may be present in an amount ranging from about 0.01 wt. % to about 30 wt. % based on the total dry weight of the body 120—including all values and sub-ranges there-between.

The fibers 130 may be organic fibers, inorganic fibers, or a blend thereof. Non-limiting examples of inorganic fibers mineral wool (also referred to as slag wool), rock wool, stone wool, and glass fibers. Non-limiting examples of organic fiber include fiberglass, cellulosic fibers (e.g. paper fiber—such as newspaper, hemp fiber, jute fiber, flax fiber, wood fiber, or other natural fibers), polymer fibers (including polyester, polyethylene, aramid—i.e., aromatic polyamide, and/or polypropylene), protein fibers (e.g., sheep wool), and combinations thereof. Depending on the specific type of material, the fibers 130 may either be hydrophilic (e.g., cellulosic fibers) or hydrophobic (e.g. fiberglass, mineral wool, rock wool, stone wool). The fibers may be present in an amount ranging from about 5 wt. % to about 99 wt. % based on the total dry weight of the body 120—including all values and sub-ranges there-between.

Non-limiting examples of the hydrophobic component include waxes, silicones, fluoro-containing additives, and combinations thereof—as discussed further herein.

The wax may have a number average molecular weight ranging from about 100 to about 10,000—including all values and sub-ranges there-between. The wax may have a melting point (Tm) ranging from about 0° C. to about 150° C.—including all values and sub-ranges there-between. In a preferred embodiment, the wax may have a melting point ranging from about 8° C. to about 137° C.—including all values and sub-ranges there-between. The wax may exhibits less than 20 wt. % of weight loss when heated to a temperature of about 260° C. In a preferred embodiment, the wax may exhibits less than 12 wt. % of weight loss when heated to a temperature of about 260° C.

Non-limiting examples of wax include paraffin wax (i.e. petroleum derived wax), polyolefin wax, as well as naturally occurring waxes and blends thereof. Non-limiting examples of polyolefin wax include high density polyethylene ("HDPE") wax, polypropylene wax, polybutene wax, polymethypentene wax, and combinations thereof. Naturally occurring waxes may include plant waxes, animal waxes, and combination thereof. Non-limiting examples of animal waxes include beeswax, tallow wax, lanolin wax, animal fax based wax, and combinations thereof. Non-limiting examples of plant waxes include soy-based wax, carnauba wax, ouricouri wax, palm wax, candelilla wax, and combinations thereof.

The hydrophobic component may be applied as a water-based emulsion. The emulsion may be anionic or non-ionic. The emulsion may have a solid content (i.e., the amount of wax within the hydrophobic component) ranging from about 20 wt. % to about 60 wt. % based on the emulsion—including all value and sub-ranges there-between.

The wax may be present in an amount ranging from about 1.0 wt. % to about 8 wt. % based on the total dry weight of the body 120—including all percentages and sub-ranges there-between. In a preferred embodiment, the wax is present in an amount of at least 1.5 wt. % based on the dry-weight of the body 120. In an even more preferred embodiment, the wax is present in an amount ranging from about 2.0 wt. % to about 4.0 wt. % based on the dry-weight of the body 120—including all percentages and sub-ranges there-between.

The silicone may be selected from a silane, a siloxane, and blends thereof. Non-limiting examples of siloxane include dimethysiloxane, silsesquioxane, aminoethylaminopropyl silsesquioxane, octamethylcyclotetrasiloxane, and combinations thereof. In some embodiments, the siloxane may be hydroxyl terminated.

Non-limiting examples of silanes include saturated compounds having hydrogen and silicon atoms and are bonded exclusively by single bonds. Each silicon atom has 4 bonds (either Si—R or Si—Si bonds), wherein R may be hydrogen (H), or a C1-C10 alkyl group—including but not limited to methyl, ethyl, propyl, butyl, etc. Each R groups is joined to a silicon atom (H—Si bonds). A series of linked silicon atoms is known as the silicon skeleton or silicon backbone. The number of silicon atoms is used to define the size of the silane (e.g., $Si_2$-silane). A silyl group is a functional group or side-chain that, like a silane, consists solely of single-bonded silicon and hydrogen atoms, for example a silyl (—$SiH_3$) or disilanyl group. The simplest possible silane (the parent molecule) is silane, $SiH_4$.

Silanes used herein may be organofunctional silanes of formula;

$$Y—R—Si—(R^1)_m(—OR^2)_{3-m}$$

where Y is a hydroxyl group or a primary or secondary amino group and $R^1$ and $R^2$ are the same or different, monovalent, optionally substituted hydrocarbon groups which comprise between 1 and 12 carbon atoms and can be interrupted with heteroatoms. Silanes operative herein illustratively include an aromatic silane or an alkyl silane. The alkyl silane may comprise linear alkyl silane such as methyl silane, fluorinated alkyl silane, dialkyl silanes, branched and cyclic alkyl silanes etc. A non-limiting example of the silane is octyltriethoxysilane.

Non-limiting examples of a siloxane may include silicon oil, such as acyclic and/or c dimethyl silicone oil—including but not limited to dimethylsiloxane, hexamethyldisiloxane, octamethyltrisiloxane, decamethylcyclopentasiloxane, octamethylcyclotetrasiloxane, and combinations thereof.

The silicone may be a water-based emulsion blend of silane and siloxane, such as commercially available IE-6682 from Dow Corning®, IE-6692 from Dow Corning®, and IE-6694 from Dow Corning®.

The fluoro-containing additives may comprise fluorocarbon-modified polyacrylate neutralized with dimethyl ethanol amine (DMEA) or a fluorosurfactant. The fluorosurfactant may be nonionic or anionic. The anionic moiety of the fluorosurfactant according to the present invention is selected from a sulfate, sulfonate, phosphate, or carboxylate moiety. According to some embodiments, the fluorosurfactant of the present invention may have at least one of the following formulas:

$$(R_fAO)S(O)_2(O^-M^+) \quad \text{Formula I:}$$

$$(R_fAO)P(O)(O^-M^+)_2 \quad \text{Formula II:}$$

$$(R_fAO)_2P(O)(O^-M^+) \quad \text{Formula III:}$$

$$(R_fAO)C(O)(O^-M^+) \quad \text{Formula IV:}$$

wherein $R_f$ is a $C_1$ to $C_{16}$ linear or branched perfluoroalkyl, which may be optionally interrupted by one, two or three ether oxygen atoms.

A is selected from: $(CH_2CF_2)_m(CH_2)_n$; $(CH_2)_oSO_2N(CH_3)(CH_2)_p$; $O(CF_2)_q(CH_2)_r$; or $OCHFCF_2OE$;

m is 0 to 4;

n, o, p, and r, are each independently 2 to 20;

q is 2;

E is a $C_2$ to $C_{20}$ linear or branched alkyl group optionally interrupted by oxygen, sulfur, or nitrogen atoms; a cyclic alkyl group, or a $C_6$ to $C_{10}$ aryl group;

M is a Group I metal or an ammonium cation $(NHx(R_2)y)^+$, wherein R2 is a $C_1$ to $C_4$ alkyl; x is 1 to 4; y is 0 to 3; and x+y is 4.

In a preferred embodiment, the body 120 is stain-repellant and formed from fibers 130 and binder, wherein the body 120 has been treated with the wax as the hydrophobic component, thereby making the body 120 stain-repellant, as discussed further herein. The wax is present in an amount ranging from about 1.5 wt. % to about 4 wt. % based on the total dry weight of the body 120. In a preferred embodiment, the wax is present in an amount of at least 1.5 wt. % based on the dry-weight of the body 120.

The body 120 in the dry-state may have a density ranging from about 40 kg/m$^3$ to about 250 kg/m$^3$—including all integers and sub-ranges there between. In a preferred embodiment, the body may have a density ranging from about 40 kg/m$^3$ to about 190 kg/m$^3$—including all values and sub-ranges there-between.

Making the body 120 stain-repellant provides a building panel 100 having a level of hydrophobicity that prevents stain-causing liquid water from being absorbed into the building panel 100 under atmospheric conditions. Specifically, a liquid water leak (e.g., liquid water leaking from mechanical line 9), which is positioned above the building panel 100 in the installed state (as shown in FIG. 7), will not penetrate the building panel 100 and pass from the second major surface 112 to the first major surface 111 of the building panel 100 under atmospheric conditions. Rather, the building panel 100 of the present invention repels the leaking liquid water and forces it to remain on the exterior of the second major surface 112, first major surface 111, and side surface 113 of the building panel 100, thereby preventing adsorption and creation of a stain on the building panel 100. For building panels formed from an untreated body (i.e., no treatment with hydrophobic component), the liquid water would be absorbed and form a visible stain on at least one of the outer surfaces of the untreated building panel.

The added benefit of liquid water repellency is that the building panel 100 of the present invention may serve as a limited protective barrier to the below active room environment 2. Specifically, by preventing liquid water from passing through the building panel 100, objects positioned directly beneath the building panel 100 will be protected from a vertically offset liquid water leak. For example, the building panel 100 may temporarily protect an object (e.g., a computer), which is located in the active room environment 2 and beneath a leak in the plenary space 3, from water-damage when the building panel 100 is positioned vertically between the leak and the object.

Another benefit of the present invention is that the stain-repellant body 120 is porous (also referred to as "porous body"). While the porous body 120 may successfully repel liquid water from penetrating and passing through the building panel 100, the porous body 120 may still allow for air and water vapor to flow between the upper surface 122 and the lower surface 121. The body 120 may be porous enough that it allows for enough airflow through the body 120 (under atmospheric conditions) for the building panel 100 to function as an acoustic ceiling panel, which requires properties related to noise reduction and sound attenuation properties—as discussed further herein.

Specifically, the body 120 of the present invention may have a porosity ranging from about 60% to about 98%—including all values and sub-ranges there between. In a preferred embodiment, the body 120 has a porosity ranging from about 75% to 95%—including all values and sub-ranges there between. According to the present invention, porosity refers to the following:

$$\%\ \text{Porosity}=[V_{Total}-(V_{Binder}+V_F+V_{HC}+V_{Filler})]/V_{Total}$$

Where $V_{Total}$ refers to the total volume of the body 120 defined by the upper surface 122, the lower surface 121, and the body side surfaces 123. $V_{Binder}$ refers to the total volume occupied by the binder in the body 120. $V_F$ refers to the total volume occupied by the fibers 130 in the body 120. $V_{filler}$ refers to the total volume occupied by the filler in the body 120. $V_{HC}$ refers to the total volume occupied by the hydrophobic component in the body 120. Thus, the % porosity represents the amount of free volume within the body 120.

The building panel 100 of the present invention comprising the porous body 120 may exhibit sufficient airflow for the building panel 100 to have the ability to reduce the amount of reflected sound in a room. The reduction in amount of reflected sound in a room is expressed by a Noise Reduction Coefficient (NRC) rating as described in American Society for Testing and Materials (ASTM) test method C423. This rating is the average of sound absorption coefficients at four ⅓ octave bands (250, 500, 1000, and 2000 Hz), where, for example, a system having an NRC of 0.90 has about 90% of the absorbing ability of an ideal absorber. A higher NRC value indicates that the material provides better sound absorption and reduced sound reflection.

The building panel 100 of the present invention exhibits an NRC of at least about 0.5. In a preferred embodiment, the building panel 100 of the present invention may have an NRC ranging from about 0.60 to about 0.99—including all value and sub-ranges there-between.

In addition to reducing the amount of reflected sound in a single room environment, the building panel 100 of the present invention should also be able to exhibit superior sound attenuation—which is a measure of the sound reduction between an active room environment 2 and a plenary space 3. The ASTM has developed test method E1414 to standardize the measurement of airborne sound attenuation between room environments 3 sharing a common plenary space 3. The rating derived from this measurement standard is known as the Ceiling Attenuation Class (CAC). Ceiling materials and systems having higher CAC values have a greater ability to reduce sound transmission through the plenary space 3—i.e. sound attenuation function.

The building panels 100 of the present invention may exhibit a CAC value of 30 or greater, preferably 35 or greater.

Figure 3:
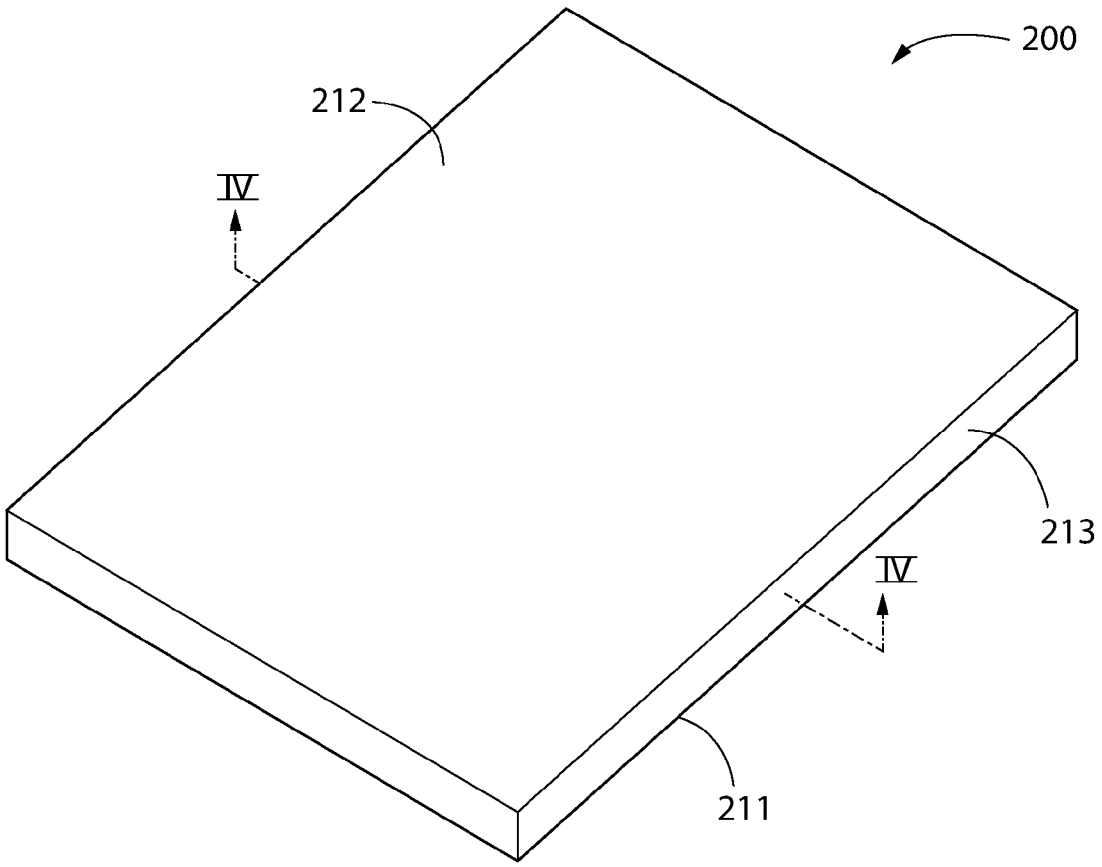
FIG. 3 is top perspective view of a building panel according to another embodiment of the present invention.
Figure 4:
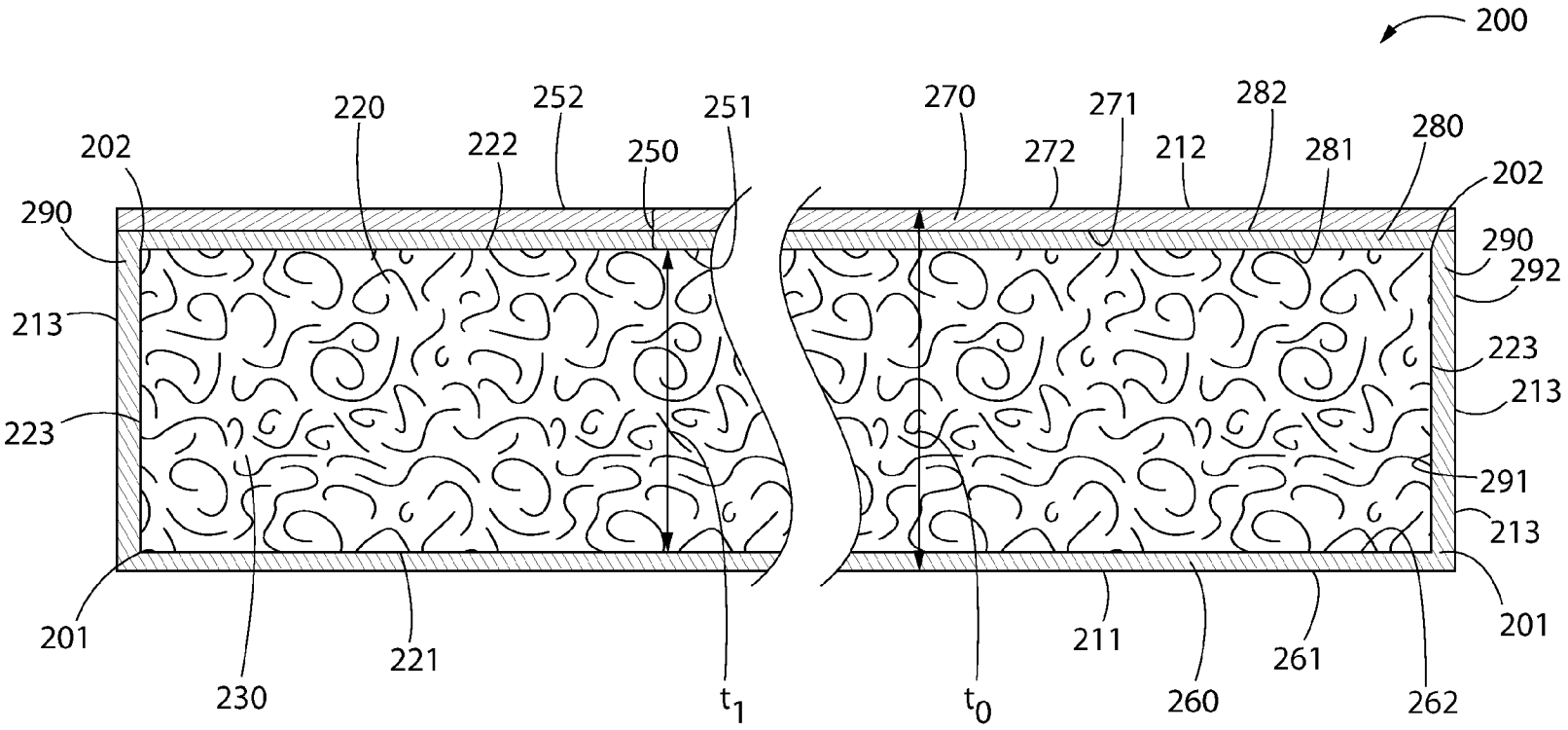
FIG. 4 is a cross-sectional view of the building panel according to the present invention, the cross-sectional view being along the IV line set forth in FIG. 2.

Referring now to FIGS. 3 and 4, a building panel 200 is illustrated in accordance with another embodiment of the present invention. The building panel 200 is similar to the building panel 100 except as described herein below. The description of the building panel 100 above generally applies to the building panel 200 described below except with regard to the differences specifically noted below. A similar numbering scheme will be used for the building panel 200 as with the building panel 100 except that the 200-series of numbers will be used.

The building panel 200 may comprise a first major surface 211 opposite a second major surface 212. The building panel 200 may further comprise a side surface 213 that extends between the first major surface 211 and the second major surface 212, thereby defining a perimeter of the ceiling panel 200. The building panel 200 may have a panel thickness $t_0$ that extends from the first major surface 211 to the second major surface 212. The panel thickness $t_0$ may range from about 12 mm to about 40 mm—including all values and sub-ranges there-between.

The building panel 200 may comprise a body 220 having an upper surface 222 opposite a lower surface 221 and a body side surface 223 extending between the upper surface 222 and the lower surface 221, thereby defining a perimeter of the body 220. The body 220 may have a body thickness $t_1$ that extends from the upper surface 222 to the lower surface 221. The body thickness $t_1$ may range from about 12 mm to about 40 mm—including all values and sub-ranges there-between.

The body 220 is a porous structure, allowing airflow through the body 220 between the upper surface 222 and the lower surface 221—as discussed further herein. The body 220 may be comprised of a binder and fibers 230. In some embodiments, the body 220 may further comprise a filler and/or additives.

The building panel 200 may further comprise a first layer 250 applied to the upper surface 222 of the body 220. The first layer 250 may have a lower surface 251 opposite an upper surface 252. The first layer 250 may be immediately adjacent to the upper surface 222 of the body 220 such that the lower surface 251 of the first layer 250 contacts the upper surface 222 of the body 220.

The first layer 250 may comprise binder. Non-limiting examples of binder may include a polyurethane binder, polyester binder, epoxy based binder (i.e., cured epoxy resin), polyvinyl alcohol (PVOH), a latex, and a combination of two or more thereof. The binder may be present in the first layer 250 in an amount ranging from about 1 wt. % to about 25 wt. % based on the total weight of the first layer 250—including all values and sub-ranges there-between.

The first layer 250 may comprise filler. Non-limiting examples of filler may include powders of calcium carbonate, including limestone, titanium dioxide, sand, barium sulfate, clay, mica, dolomite, silica, talc, perlite, polymers, gypsum, wollastonite, expanded-perlite, calcite, aluminum trihydrate, pigments, zinc oxide, or zinc sulfate. The filler may be present in an amount ranging from about 25 wt. % to about 99 wt. % based on the total dry weight of the first layer 250—including all values and sub-ranges there-between.

The first layer 250 may be comprised of one or more sub-layers. The first layer 250 may comprise a first sub-layer 270 having an upper surface 272 opposite a lower surface 271. The first layer 250 may comprise a second sub-layer 280 having an upper surface 282 opposite a lower surface 281.

The first sub-layer 270 may be positioned adjacent to and atop the second sub-layer 280, and the second sub-layer 280 may be positioned adjacent to and atop the body 220. Specifically, the lower surface 281 of the second sub-layer 280 may contact the upper surface 222 of the body 220. The upper surface 282 of the second sub-layer 280 may contact the lower surface 271 of the first sub-layer 270.

In some embodiments, the first layer 250 may further comprise a third sub-layer (or additional sub-layers) that is positioned between the lower surface 281 of the second sub-layer 280 and the upper surface 222 of the body 220 (not pictured).

The upper surface 272 of the first sub-layer 270 may form the top-most surface of the building panel 200. Stated otherwise, the second major surface 212 of the building panel 200 may comprise the upper surface 272 of the first sub-layer 270.

The first sub-layer 270 may comprise a hygroscopic component. In some embodiments, the first sub-layer 270 may further comprise the hydrophobic component (as previously discussed). The combination of the hygroscopic component and the hydrophobic component help provide a building panel 200 that is not only sag-resistant (due to the hygroscopic component) but also stain resistant (due to hydrophobic component). The first sub-layer 270 may further comprise binder, filler, and/or additive (as previously discussed).

The hygroscopic component may be present in an amount ranging from about 5 wt. % to about 50 wt. % based on the total weight of the first sub-layer 270 in the dry state—including all value and sub-ranges there-between. According to the present invention, the term "hygroscopic" means a composition that is capable of attracting and holding water vapor from the surrounding environment under atmospheric conditions. According to the present invention, the term "hygroscopic" also means a composition that exhibits a degree of expansion when exposed to water vapor. Therefore, layers comprising the hygroscopic component may be useful in increasing sag-resistance to the building panel 200 because the expansion forces exerted by hygroscopic expansion when exposed to water vapor counter the compressive force created by the additional water vapor weight under the force of gravity (which would otherwise cause the building panel to sag). Countering the compressive force by hygroscopic expansion is useful in preventing sag in ceiling panels when that ceiling panel is exposed to elevated moisture levels from the surrounding environment—as discussed further herein.

Non-limiting examples of the hygroscopic component includes the reaction product of at least one polycarboxyl polymer and one polyol. Non-limiting examples of the polycarboxyl polymers include polyacrylic acid, polyacrylic acid ammonium salt, polystyrene maleic acid, polystyrene maleic ammonium salt, polystyrene maleic anhydride, and combinations thereof. Non-limiting examples of the polyol include diethanol amine, triethanol amine, glycerol, glucose, sucrose, fructose, sorbitol, polyvinyl alcohol, pentaerythritol, and combinations thereof.

The resulting hygroscopic component comprises polymer chains of the polycarboxyl polymer that have been cross-linked via ester bonds formed between the free carboxylic acid groups (COOH) present on the polycarboxyl polymer and free hydroxyl groups (OH) present on the polyol. Additionally, after cross-linking, the resulting hygroscopic component still comprises a plurality of at least one of free carboxylic acid groups, hydroxyl groups, or a combination thereof. For the hygroscopic polymer based on polycarboxyl polymers comprising ammonium salt, the resulting hygroscopic component may further comprises amide groups. The presence of at least one of hydroxyl, carboxylic acid, and amide group, thereby providing the hygroscopic properties to the hygroscopic component.

The hydrophobic component may be present in an amount ranging from about 0.1 wt. % to about 10 wt. % based on the total weight of the first sub-layer 270 in the dry state—including all value and sub-ranges there-between. The binder may be present in an amount ranging from about 1 wt. % to about 50 wt. % based on the total dry-state weight of the first sub-layer 270—including all value and sub-ranges there-between. The filler may be present in an amount ranging from about 50 wt. % to about 99 wt. % based on the total dry-state weight of the first sub-layer 270—including all value and sub-ranges there-between. The additives may be present in an amount ranging from about 0.02 wt. % to about 5 wt. % based on the total dry-state weight of the first sub-layer 270—including all value and sub-ranges there-between.

The first sub-layer 270 may, in the dry-state, be present in an amount ranging from about 50 g/m$^2$ to about 250 g/m$^2$—including all values and sub-ranges there-between. The first sub-layer 270 may be continuous.

The second sub-layer 280 may comprise the hydrophobic component. The second sub-layer 280 may further comprise binder. In some embodiments, the second sub-layer 280 may further comprise filler and/or additive.

The hydrophobic component may be present in an amount ranging from about 0.1 wt. % to about 10 wt. % based on the total dry-state weight of the second sub-layer 280—including all value and sub-ranges there-between. The binder may be present in an amount ranging from about 1 wt. % to about 50 wt. % based on the total dry-state weight of the second sub-layer 280—including all value and sub-ranges there-between. The filler may be present in an amount ranging from about 50 wt. % to about 99 wt. % based on the total dry-state weight of the second sub-layer 280—including all value and sub-ranges there-between. The additives may be present in an amount ranging from about 0.02 wt. % to about 5 wt. % based on the total dry-state weight of the second sub-layer 280—including all value and sub-ranges there-between.

The second sub-layer 280 may, in the dry-state, be present in an amount ranging from about 50 g/m$^2$ to about 250 g/m$^2$—including all values and sub-ranges there-between. The second sub-layer 280 may be discontinuous.

The building panel 200 may comprise a second layer 260 applied to the lower surface 221 of the body 220. The second layer 260 may have a lower surface 261 opposite an upper surface 262. The second layer 260 may be immediately adjacent to the lower surface 221 of the body 220 such that the upper surface 262 of the second layer 260 contacts the lower surface 221 of the body 220.

The second layer 260 may comprise binder. Non-limiting examples of binder may include a polyurethane binder, polyester binder, epoxy based binder (i.e., cured epoxy resin), polyvinyl alcohol (PVOH), a latex, and a combination of two or more thereof. The binder may be present in the second layer 260 in an amount ranging from about 1 wt. % to about 25 wt. % based on the total weight of the second layer 260—including all values and sub-ranges there-between.

The second layer 260 may comprise filler. Non-limiting examples of filler may include powders of calcium carbonate, including limestone, titanium dioxide, sand, barium sulfate, clay, mica, dolomite, silica, talc, perlite, polymers, gypsum, wollastonite, expanded-perlite, calcite, aluminum trihydrate, pigments, zinc oxide, or zinc sulfate. The filler may be present in an amount ranging from about 25 wt. % to about 99 wt. % based on the total dry weight of the second layer 260—including all values and sub-ranges there-between. The second layer 260 may further comprise the hydrophobic component. The second layer 260 may comprise one or more sub-layers (not pictured).

The lower surface 261 of the second layer 260 may form the lower-most surface of the building panel 200. Stated otherwise, the first major surface 211 of the building panel 200 may comprise the lower surface 261 of the second layer 260. The second layer 260 may, in the dry-state, be present in an amount ranging from about 50 g/m$^2$ to about 250 g/m$^2$—including all values and sub-ranges there-between. The second layer 260 may be discontinuous.

The second layer 260 may comprise the hydrophobic component. The second layer 260 may further comprise a binder. In some embodiments, the second layer 260 may further comprise a filler and/or additive. The hydrophobic component may be present in an amount ranging from about 0.1 wt. % to about 10 wt. % based on the total dry-state weight of the second layer 260—including all value and sub-ranges there-between. The binder may be present in an amount ranging from about 1 wt. % to about 50 wt. % based on the total dry-state weight of the second layer 260—including all value and sub-ranges there-between. The filler may be present in an amount ranging from about 50 wt. % to about 99 wt. % based on the total dry-state weight of the second layer 260—including all value and sub-ranges there-between. The additives may be present in an amount ranging from about 0.02 wt. % to about 5 wt. % based on the total dry-state weight of the second layer 260—including all value and sub-ranges there-between.

In some embodiments, when the first sub-layer 270 comprises both the hygroscopic component and the hydrophobic component, the second sub-layer 280 may be omitted or the second sub-layer may be substantially free of the hydrophobic component, or, those some embodiments, the second sub-layer may be omitted entirely from the building panel 200. In such embodiment, the second sub-layer may comprise epoxy-based binder.

The building panel 200 may further comprise one or more side layers 290 positioned immediately adjacent to one or more side surfaces 213 of the body 220. The side layers 290 may comprise an inner surface 291 opposite an outer surface 292. The inner surface 291 may be positioned immediately adjacent to the side surface 213 of the body 220. The outer surface 292 of the side layer 290 may form the outermost surface of the building panel 200. Stated otherwise, the side surface 213 of the building panel 200 may comprise the outer surface 292 of the side layer 290.

The side layers 290 may comprise binder. Non-limiting examples of binder may include a polyurethane binder, polyester binder, epoxy based binder (i.e., cured epoxy resin), polyvinyl alcohol (PVOH), a latex, and a combination of two or more thereof. The binder may be present in the side layers 290 in an amount ranging from about 1 wt. % to about 25 wt. % based on the total weight of the side layers 290—including all values and sub-ranges there-between.

The side layers 290 may comprise filler. Non-limiting examples of filler may include powders of calcium carbonate, including limestone, titanium dioxide, sand, barium sulfate, clay, mica, dolomite, silica, talc, perlite, polymers, gypsum, wollastonite, expanded-perlite, calcite, aluminum trihydrate, pigments, zinc oxide, or zinc sulfate. The filler may be present in an amount ranging from about 25 wt. % to about 99 wt. % based on the total dry weight of the side layers 290—including all values and sub-ranges there-between.

In a preferred embodiment, side layers 290 are applied to each of the side surfaces 213 of the body 220—thereby encapsulating the entire perimeter of the body 220. In such preferred embodiment, the side layers 290, in combination with the first layer 250 and the second layer 260, fully encapsulate the body 220 to form the building panel 200. The side layers 290 meet the first layer 250 at a first overlap point 202 whereby the first layer 250 and side layer 290 seal the edge existing at the intersection of the side surface 213 and the upper surface 222 of the body 220. The side layers 290 meet the second layer 260 at a second overlap point 201 whereby the second layer 260 and side layer 290 seal the edge existing at the intersection of the side surface 213 and the lower surface 221 of the body 220.

The side layers 290 may comprise the hydrophobic component. The hydrophobic component may be present in an amount ranging from about 0.1 wt. % to about 10 wt. % based on the total dry-state weight of the side layer 290—including all value and sub-ranges there-between. Each side layer 290 may present on the building panel 200 in an amount ranging from about 10 g/linear meter to about 50 g/linear meter—including all values and sub-ranges there-between. The side layers 290 may be continuous.

According to the present invention, the building panel 200 may have the first and second layers 250 and 260 (as well as the side layers 290) without substantially degrading the desired NRC performance of the building panel 200. Specifically, the body 220 may exhibit a first NRC value as measured between the lower surface 221 and the upper surface 222. Additionally, when the second layer 260 is applied to the body 220, the building panel will exhibit a second NRC performance that is at least 90% of the first NRC value, wherein the NRC value is measured from the lower surface 261 of the second layer to the upper surface 222 of the body 220. Although the second NRC value is not measured through the first layer 250, the body 220 and the second layer 260 nonetheless exhibit sufficient airflow for the overall building panel 200 to provide the requisite noise reduction in an active room environment 2.

Furthermore, the addition of the first layer 250 atop the upper surface 222 of the body 220 further enhances the overall CAC performance of the building panel 200 as measured between the first major surface 211 and the second major surface 212 of the building panel 200. Specifically, the body 200 may exhibit a first CAC value—as measured between the lower surface 221 and the upper surface 222 of the body 220 and the building panel 200 will exhibit a second CAC value as measured between the first major surface 211 and the second major surface 212 of the building panel 200. The second CAC value will be greater than the first CAC value.

Figure 5:
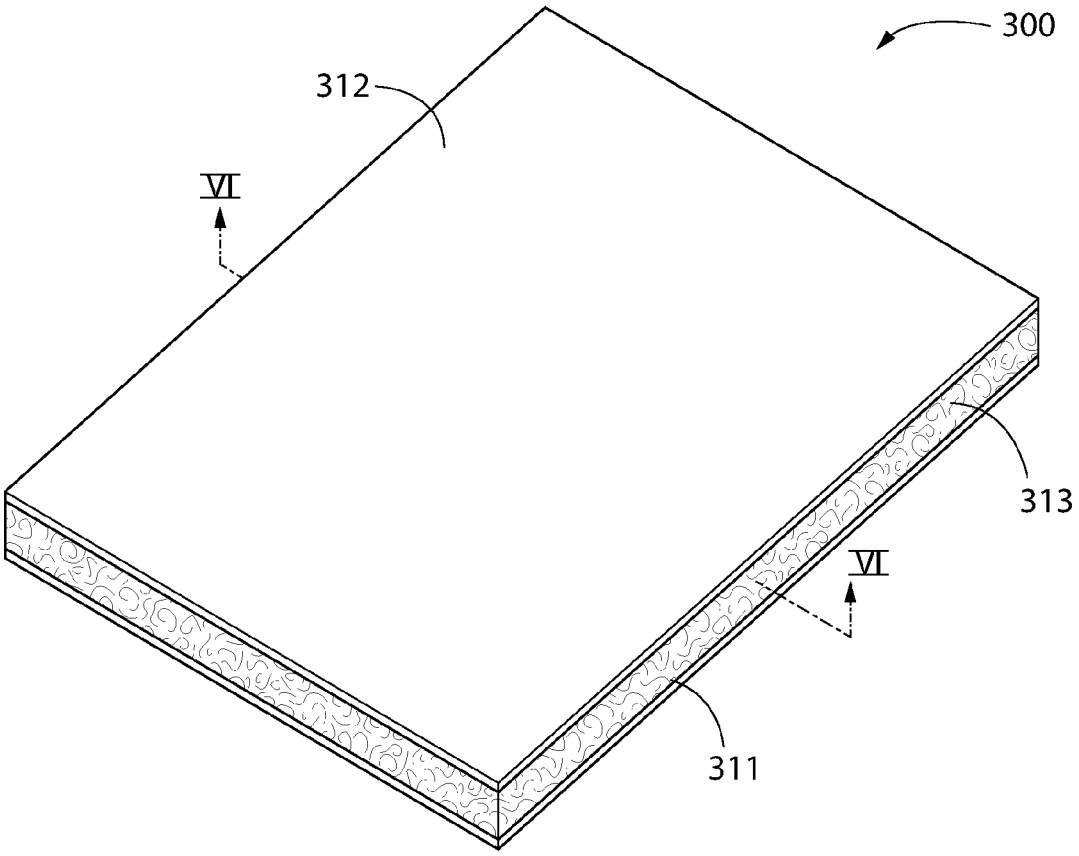
FIG. 5 is top perspective view of a building panel according another embodiment of the present invention.
Figure 6:
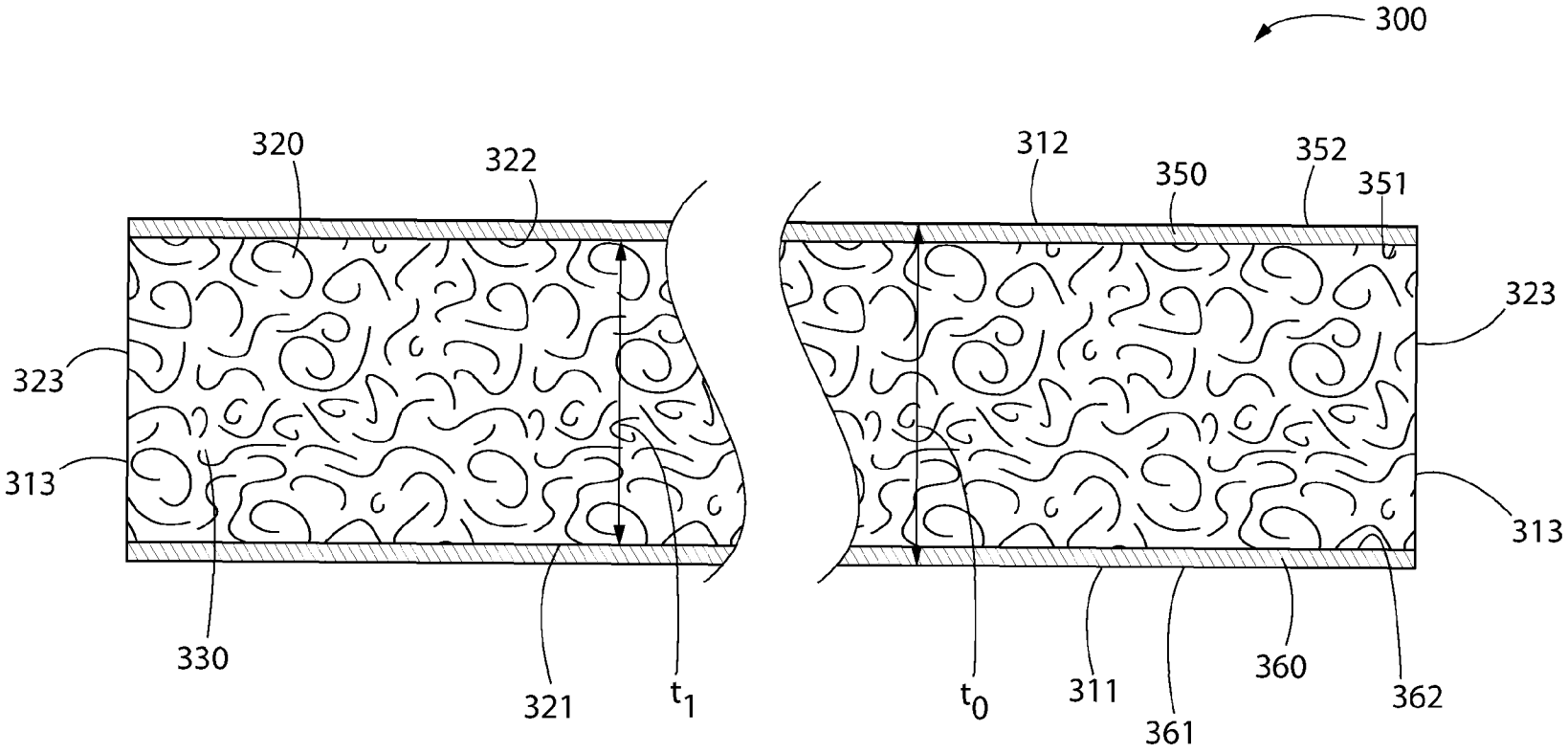
FIG. 6 is a cross-sectional view of the building panel according to the present invention, the cross-sectional view being along the VI line set forth in FIG. 5.

Referring to FIGS. 5 and 6, a building panel 300 is illustrated in accordance with another embodiment of the present invention. The building panel 300 is similar to the building panels 100 and 200 except as described herein below. The description of the building panels 100 and 200 above generally applies to the building panel 300 described below except with regard to the differences specifically noted below. A similar numbering scheme will be used for the building panel 300 as with the building panels 100 and 200 except that the 300-series of numbers will be used.

The building panel 300 may comprise a first major surface 311 opposite a second major surface 312. The building panel 300 may further comprise a side surface 313 that extends between the first major surface 311 and the second major surface 312, thereby defining a perimeter of the ceiling panel 300. The building panel 300 may have a panel thickness $t_0$ that extends from the first major surface 311 to the second major surface 312. The panel thickness $t_0$ may range from about 12 mm to about 40 mm—including all values and sub-ranges there-between.

The building panel 300 may comprise a body 320 having an upper surface 322 opposite a lower surface 321 and a body side surface 323 extending between the upper surface 322 and the lower surface 321, thereby defining a perimeter of the body 320. The body 320 may have a body thickness $t_1$ that extends from the upper surface 322 to the lower surface 321. The body thickness $t_1$ may range from about 12 mm to about 40 mm—including all values and sub-ranges there-between.

The body 320 may be comprised of binder and fibers 330. The body 320 may be treated with the hydrophobic component, thereby making the body 320 stain-repellant. The body 320 is porous, thereby allowing airflow through the body 320 between the upper surface 322 and the lower surface 321—as discussed further herein. In some embodiments, the body 320 may further comprise filler. The hydrophobic component may be present in an amount ranging from about 1.5 wt. % to about 4 wt. % based on the total dry weight of the body 320.

The building panel 300 may comprise a first layer 350 having a lower surface 351 opposite an upper surface 352. The first layer 350 may be immediately adjacent to the upper surface 322 of the body 320. The first layer 350 may be applied directly to the upper surface 322 of the body 320 such that the lower surface 351 of the first layer 350 contacts the upper surface 322 of the body 320. The first layer 350 may further comprise binder, filler, and/or additive. The first layer 350 may comprise the hygroscopic composition. In some embodiments, the first layer 350 may further comprise the hydrophobic component.

In some embodiments, the first layer 350 may comprise both the hygroscopic component and the hydrophobic component. In other embodiments, when the first layer 350 is substantially free of the hydrophobic component, the first layer 350 also substantially free of the hygroscopic component.

The hygroscopic component may be present in an amount ranging from about 5 wt. % to about 50 wt. % based on the total weight of the first layer 350 in the dry state—including all value and sub-ranges there-between. The hydrophobic component may be present in an amount ranging from about 0.1 wt. % to about 10 wt. % based on the total weight of the first layer 350 in the dry state—including all values and sub-ranges there-between. The binder may be present in an amount ranging from about 1 wt. % to about 50 wt. % based on the total dry-state weight of the first layer 350—including all values and sub-ranges there-between. The filler may be present in an amount ranging from about 50 wt. % to about 99 wt. % based on the total dry-state weight of the first layer 350—including all values and sub-ranges there-between. The additives may be present in an amount ranging from about 0.02 wt. % to about 5 wt. % based on the total dry-state weight of the first layer 350—including all values and sub-ranges there-between.

The amount of dry-state first layer 350 present on the building panel 300 may range from about 50 g/m$^2$ to about 250 g/m$^2$—including all values and sub-ranges there-between. The first layer 350 may be continuous.

The building panel 300 may comprise a second layer 360 having a lower surface 361 opposite an upper surface 362. The second layer 360 may be immediately adjacent to the lower surface 321 of the body 320. The second layer 360 may be applied directly to the lower surface 321 of the body 320 such that the upper surface 362 of the second layer 360 contacts the lower surface 321 of the body 320.

The second layer 360 may comprise the hydrophobic component. The second layer 360 may further comprise binder, filler, and/or additive. The hydrophobic component may be present in an amount ranging from about 0.1 wt. % to about 10 wt. % based on the total dry-state weight of the second layer 360—including all values and sub-ranges there-between. The binder may be present in an amount ranging from about 1 wt. % to about 50 wt. % based on the total dry-state weight of the second layer 360—including all value and sub-ranges there-between. The filler may be present in an amount ranging from about 50 wt. % to about 99 wt. % based on the total dry-state weight of the second layer 360—including all value and sub-ranges there-between. The additives may be present in an amount ranging from about 0.02 wt. % to about 5 wt. % based on the total dry-state weight of the second layer 360—including all value and sub-ranges there-between. In some embodiments, the second layer 360 may be substantially free of hydrophobic component.

The second layer 360 may be present on the lower surface 361 of the building panel 300 in an amount ranging from about 50 g/m$^2$ to about 250 g/m$^2$—including all values and sub-ranges there-between. The second layer 360 may be discontinuous.

The upper surface 352 of the first layer 350 may form the top-most surface of the building panel 300. Stated otherwise, the second major surface 312 of the building panel 300 may comprise the upper surface 272 of the first layer 250. The lower surface 261 of the second layer 360 may form the lower-most surface of the building panel 300. Stated otherwise, the first major surface 311 of the building panel 300 may comprise the lower surface 262 of the second layer 260. Additionally, the side surface 313 of the building panel 300 may comprise the body side surfaces 323 of the body 320—such that the stain-repellant fibrous material 340 is exposed on the side surfaces 313 of the building panel 300.

According to the present invention, the body 120, 220, 320 may be formed according to a standard wet-laid process that uses an aqueous medium (e.g., liquid water) to transport and form the body components into the desired structure. The basic process involves first blending the various body ingredients (e.g., fibers, binder, filler, etc.) into an aqueous slurry—(i.e., the wet-state), transporting the slurry to a head box forming station, and distributing the slurry over a moving, porous wire web into a uniform mat having the desired size and thickness. Water is removed, and the mat is then dried (i.e., the dry-state). The dried mat may be finished into the body by slitting, punching, coating and/or laminating a surface finish to the tile.

According to the embodiments where the body 120, 320 is stain-repellant—the wax is added to the fiber 130, 330 and binder during the wet-laid process. Specifically, the wax (which may be in the form of an emulsion) may be added to the fibers 130, 330 and binder in an aqueous medium to form a fiber-slurry. Other component may be added to the fiber-slurry, and after a period of time whereby the fiber-slurry is agitated, the fiber-slurry may further treated, thereby the completing the wet-laid process. The body 120, 320 in the wet-state may be heated at an elevated temperature ranging from about 60° C. to about 300° C.—including all values and sub-ranges there-between—to dry the body 120, 320 from the wet-state to the dry-state, but also may have the added benefit of more uniformly distributing the wax throughout the body 120, 320—thereby enhancing the liquid water repellency of the stain-resistant body 120, 320. Specifically, the drying temperature of the body 120, 320 in the wet-state may reach a temperature that is greater than the melting temperature of the hydrophobic component (i.e., wax) that is used to treat the body 120, 320 to become stain-repellant. Such temperature relationship will help uniformly distribute the hydrophobic component throughout the body 120, 320, thereby preventing liquid water from passing through the body while allowing air and water vapor to pass through the body 120, 320 under atmospheric conditions.

After manufacturing the body 200, 300 of the present invention the first layer 250, 350, second layer 260, 360, and optionally side layers 290 may be applied to the body 200, 300. Specifically, the various layers may be applied individually, in a wet-state, by spray coating, roll coating, dip coating, and a combination thereof—followed by drying at a temperature ranging from about 60° C. to about 300° C.—including all values and sub-ranges there-between.

EXAMPLES

The following experiments use the following hydrophobic components:

Hydrophobic Agent A:

non-ionic silane-siloxane comprising triethoxy(octyl) silane, octamethyl cyclotetrasiloxane, and dimethylsiloxane;

Hydrophobic Agent B:

fluorosurfactant comprising a partially fluorinated alcohol; and

Hydrophobic Agent C:

wax emulsion comprising a mixture of (1) paraffin wax and (2) vegetable wax (carnauba wax).

Hydrophobic Agent D:

wax emulsion comprising polyolefin.

Experiment 1

The following experiment measures the stain resistance in an acoustical building panel comprising a stain repellant body formed from fibers comprising a mixture of mineral fiber and recycled cellulosic fiber. Two bodies according to the present invention were prepared by mixing together the fibers, binder, filler, and hydrophobic component with water to form a slurry, which was then agitated for a period of time and then formed into a body by a wet-laid process. The body was then dried at a temperature of about 204° C.

The first inventive body had 1 wt. % of hydrophobic component based on the total dry-weight of the body. The second inventive body had 2 wt. % of hydrophobic component based on the total dry-weight of the body. The hydrophobic component comprising Hydrophobic Component D, discussed further herein.

The hydrophobic component treated bodies were then submerged in municipal supplied water for a period of 24 hours after which each test sample was analyzed for water penetration and stain formation in the body. A first comparative body (i.e., Comparative Example 1) was formed by the same process except without the addition of the hydrophobic component. Second and third comparative bodies were formed by the same process except with only 0.25 wt. % and 0.5 wt. % of hydrophobic treatment based on the total weight of the dry body (i.e., Comparative Examples 2 and 3, respectively). The comparative bodies were subjected to the same 24 hour submersion tests. The results are provided below in Table 1.

TABLE 1

| | Comp. Ex. 1 | Comp. Ex. 2 | Comp. Ex. 3 | Ex. 1 | Ex. 2 |
|---|---|---|---|---|---|
| Dry Wax | 0 wt. % | 0.25 wt. % | 0.5 wt. % | 1 wt. % | 2 wt. % |
| Liquid Water Pass Through | Yes[B] | Yes[B] | Yes[B] | Slight[A] | No[A] |
| Stain | Heavy Stain[B] | Heavy Stain[B] | Medium Stain[B] | Light Stain[A] | No Stain[A] |

Superscript "A" refers to a commercially acceptable product—which may be no staining and liquid pass-through at all or slight discoloration and/or slight liquid pass-through (still meeting commercially acceptable standards for building panels). Superscript "B" refers to a commercially unacceptable product as a building panel.

The wax treatment of the body comprising at least 1 wt. % of the wax not only provided commercially acceptable stain resistance after a 24 hour period of water submersion, but the body also exhibited resistance to liquid water passing through the body.

Experiment 2

Prior to the water submersion tests of Experiment 1, the NRC values were measured for the building panels of Example 2 vs. Control 1. The results of the NRC test are provided below in Table 2

TABLE 2

| | Comp. Ex. 1 | Ex. 2 |
|---|---|---|
| NRC | 0.61 | 0.60 |
| % Change | — | <1.8% |

As demonstrated by Table 1, the wax treatment of the body had not only had negligible effect on the NRC performance of the resulting building panel (a decrease in NRC performance less than 2%), thereby providing that, in addition to superior stain resistance, the building panel can continue to operate effectively as an acoustic ceiling panel.

Experiment 3

The following experiment measures the stain resistance in an acoustical building panel comprising an encapsulated body having a first layer, second layer, and side surface layers. The body is formed from fibers comprising a mixture of mineral fiber and recycled cellulosic fiber. Unlike the building panel of Examples 1 and 2, the body used to form the building panel of Example 3 is not treated with hydrophobic component.

A first coating composition comprising an epoxy binder and filler in a wet-state (i.e. with water at a solids content of 50 wt. %) to the upper surface of the body. The first coating is dried to form a discontinuous first sub-layer (i.e. dry-state).

Subsequently, a second coating composition in a wet-state (i.e., with water at a solids content of 50 wt. %) comprising binder, filler, hydrophobic component (Hydrophobic Agent C), and hygroscopic component comprising a mixture of polyacrylic acid and polyol, is applied to the upper surface of the first sub-layer. The second coating is dried to form a continuous second sub-layer. The Hydrophobic Agent C is present in the second sub-layer in an amount of about 6.5 wt. % based on the total dry weight of the second sub-layer (i.e. dry state). The hygroscopic component is present in the second sub-layer in an amount of about 15 wt. % based on the total dry weight of the second sub-layer (i.e. dry-state). The second sub-layer is atop the first sub-layer. Together, the first sub-layer and the second sub-layer form the first layer.

A third coating composition in a wet-state (i.e. with water in a solids content of about 50 wt. %) comprising binder, hydrophobic component (Hydrophobic Agent A), and filler in is applied to the lower surfaces of the body. The third coating is dried to form a discontinuous second layer (i.e. dry-state). The second layer comprises about 5 wt. % of the Hydrophobic Component A based on the total dry weight of the second layer (i.e. dry-state).

A fourth coating composition in a wet-state (i.e. with water at a solids content of 60 wt. %) comprising binder, hydrophobic component (Hydrophobic Agent B) and filler is the applied to the side surfaces of the body. The fourth coating is dried to form a continuous third layer on the side/edge of the body (i.e. dry-state), wherein the third layer comprises about 0.3 wt. % of Hydrophobic Agent B based on the total dry weight of the third layer.

The combination of first, second, and third layers fully encapsulate the body to form the building panel. A total of four building panels are produced for testing. Five comparative examples were also prepared having either: one, two, or none of the layers applied to the body.

The building panel is then subjected to a burette drip test, whereby water is applied to the second major surface (i.e., the back surface of the building panel that faces the plenary space in a ceiling system) of the building panel at a rate of 1 drop/second for a period of 20 minutes up to 3 hours. The first major surface of the building panel (i.e., the front surface of the building panel that faces the active room environment) was then observed for staining.

The results are provided below in Table 3.

TABLE 3

| | Comp. Ex. 4 | Comp. Ex. 5 | Comp. Ex. 6 | Comp. Ex. 7 | Comp. Ex. 8 | Ex. 3 |
|---|---|---|---|---|---|---|
| First Layer | No | Yes | Yes | Yes | Yes | Yes |
| Hydrophobic Agent | — | A | B | A | B | C |
| Second Layer | No | No | No | No | No | Yes |
| Hydrophobic Agent | — | — | — | — | — | A |
| Third Layer | No | No | No | Yes | Yes | Yes |
| Hydrophobic Agent | — | — | — | A | B | B |
| Stain | Yes | Yes | Yes | Yes | Yes | No |

The building panel of Example 3 having the fully encapsulated body was the only to exhibit resistance to staining.

Experiment 4

The following experiment measures the sag resistance in a building panel comprising an encapsulated body having a first layer, second layer, and side surface layers. Two building panels were prepared, each building panel having a body formed from un-treated mineral fibers and recycled cellulosic fiber.

The first building panel was prepared by encapsulating a body. A first coating composition in a wet-state (i.e., with water at a solids content of 50 wt. %) comprising binder, filler, hydrophobic component (Hydrophobic Agent C), and hygroscopic component comprising a mixture of polyacrylic acid and polyol, is applied to the upper surface of the body. The first coating composition is dried to form a continuous first layer. The Hydrophobic Agent C is present in the first layer in an amount of about 6.5 wt. % based on the total dry weight of the first layer (i.e. dry state). The hygroscopic component is present in the first layer in an amount of about 15 wt. % based on the total dry weight of the first layer (i.e. dry-state). The first layer is atop the upper surface of the body A second coating composition in a wet-state (i.e. with water in a solids content of about 50 wt. %) comprising binder, hydrophobic component (Hydrophobic Agent A), and filler in is applied to the lower surface of the body. The second coating composition is dried to form a discontinuous second layer (i.e. dry-state). The second layer comprises about 5 wt. % of the Hydrophobic Component A based on the total dry weight of the second layer (i.e. dry-state).

A third coating composition in a wet-state (i.e. with water at a solids content of 60 wt. %) comprising binder, hydrophobic component (Hydrophobic Agent B) and filler is the applied to the side surfaces of the body. The third coating composition is dried to form a continuous third layer on the side/edge of the body (i.e. dry-state), wherein the third layer comprises about 0.3 wt. % of Hydrophobic Agent B based on the total dry weight of the third layer.

The combination of first, second, and third layers fully encapsulate the body to form the building panel (represented by inventive Example 4). A second building panel was prepared that was free of any layers applied to the body (represented by Comparative Example 9).

Both building panels were then subjected to a relative humidity (RH) of 35% and 90% at 80° F. for a number of cycles—each cycle being for an equal period of time. The resulting sag performance of each building panel was measured along with any possible staining of the first major surface of the building panel (i.e., the front surface of the building panel that faces the active room environment) was observed. The resulting performance for each building panel is set forth below in Table 4.

TABLE 4

| | Ex. 4 | Comp. Ex. 9 |
|---|---|---|
| Initial | 0 mils | 0 mils |
| Cycle 1 RH 100 | 5 mils | −350 mils |
| Cycle 1 RH 35 | −100 mils | −475 mils |
| Cycle 2 RH 100 | −10 mils | −500 mils |
| Cycle 2 RH 35 | −80 mils | −550 mils |
| Cycle 3 RH 100 | 5 mils | −570 mils |
| Cycle 3 RH 35 | −60 mils | −580 mils |
| Cycle 4 RH 100 | 0 mils | −600 mils |
| Cycle 4 RH 35 | −60 mils | −660 mils |
| Stain | No | Yes |

The building panel of Example 4 not only exhibits stain-resistance but also exhibited superior resistance to sag during each humidity cycle (as compared to the building panel of Comparative Example 9).

Experiment 5

The following experiment demonstrates the stain resistance imparted the hydrophobic agent when used in combination with the hygroscopic component of the first layer on a body not treated with a hydrophobic component (such as the body of Example 1). Specifically, three building panels were subjected to the burette drip test. Each panel has a body formed from fibers comprising a mixture of mineral fiber and recycled cellulosic fiber.

The first building panel was the same as used in Comparative Example 1 (referred to Comparative Example 10 in this experiment).

The second building panel was prepared (referred to Comparative Example 11 in this experiment) having a first layer applied to an upper surface of a body. The first layer comprising binder, filler, and hygroscopic component (a mixture of polyacrylic acid and polyol) in an amount of about 15 wt. % based on the total dry-weight of the first layer. The first layer is continuous and does not comprise the hydrophobic component. The second building panel further comprises a second layer applied to a lower surface of the body. The second layer of comprises binder, filler, and hydrophobic component comprising Hydrophobic Agent A in an amount of about 5 wt. % based on the total dry-weight of the second layer. The second layer is discontinuous. The second building panel further comprises a third layer applied to the side surfaces of the body. The third layers comprises binder, hydrophobic component comprising Hydrophobic Agent B in an amount of about 0.3 wt. % based on the total dry-weight of the third layer. The third layers are continuous.

A third building panel was prepared (referred to Example 5) having a first layer applied to the upper surface of the body. The first layer is continuous and comprises binder, filler, hygroscopic component, and hydrophobic component. The hygroscopic component comprising a mixture of polyacrylic acid and polyol that is present in an amount of about 15 wt. % based on the total dry-weight of the first layer. The hydrophobic component comprises Hydrophobic Agent C in an amount of about 6.5 wt. % based on the total dry-weight of the first layer.

The third building panel further comprises a second layer applied to a lower surface of the body. The second layer of comprises binder, filler, and hydrophobic component comprising Hydrophobic Agent A in an amount of about 5 wt. % based on the total dry-weight of the second layer. The second layer is discontinuous. The third building panel further comprises a third layer applied to the side surfaces of the body. The third layer comprises binder, hydrophobic component comprising Hydrophobic Agent B in an amount of about 0.3 wt. % based on the total dry-weight of the third layer. The third layers are continuous.

The building panel is then subjected to a burette drip test, whereby water is applied to the second major surface of the building panel (i.e., the back surface of the building panel that faces the plenary space in a ceiling system) at a rate of 1 drop/second for a period of 20 minutes up to 3 hours. The first major surface of the building panel (i.e., the front surface of the building panel that faces the active room environment) was then observed for staining.

The resulting performance for each building panel is set forth below in Table 5.

TABLE 5

| | Comp. Ex. 10 | Comp. Ex. 11 | Ex. 5 |
|---|---|---|---|
| First Layer | No | Yes | Yes |
| Hydrophobic Component | — | — | Yes |
| Hygroscopic Component | — | Yes | Yes |
| Stain | Yes | Yes | No |

Table 5 clearly shows that the hygroscopic component present in the first layer will stain the board, however, the addition of hydrophobic additives into the first layer prevents stain.

What is claimed is:

1. An acoustic ceiling panel comprising:

a porous body having an upper surface opposite a lower surface and at least one side surface extending between the upper surface and the lower surface;

a first layer applied to the upper surface, the first layer comprising a hygroscopic component and a first hydrophobic component.

2. The acoustic ceiling panel according to claim 1, wherein a second layer is applied to the lower surface, the second layer comprising a second hydrophobic component, the second hydrophobic component comprising at least one of a silicone, wax, fluoro-surfactant, and combinations thereof.

3. The acoustic ceiling panel according to claim 2, wherein the second layer is discontinuous.

4. The acoustic ceiling panel according to claim 1, wherein the first hydrophobic component comprises at least one of a silicone, wax, fluoro-surfactant, and combinations thereof.

5. The acoustic ceiling panel according to claim 1, wherein the hygroscopic component comprises the reaction product of a polycarboxyl polymer and a polyol.

6. The acoustic ceiling panel according to claim 5, wherein polycarboxyl polymers are selected from polyacrylic acid, polyacrylic acid ammonium salt, polystyrene maleic acid, polystyrene maleic ammonium salt, and polystyrene maleic anhydride; and the polyol is selected from diethanol amine, triethanol amine, glycerol, glucose, sucrose, fructose, sorbitol, polyvinyl alcohol, and pentaerythritol.

7. The acoustic ceiling panel according to claim 2, wherein the first layer comprises and an upper surface opposite a lower surface; the second layer comprises an upper surface opposite a lower surface; and the acoustic ceiling panel comprises a first major surface opposite a second major surface, wherein the first major surface comprises the upper surface of the first layer and the second major surface comprises the lower surface of the second layer.

8. The acoustic ceiling panel according to claim 7, wherein the porous body has a first NRC value of at least 0.5 as measured from the upper surface to the lower surface of the porous body.

9. The acoustic ceiling panel according to claim 7, wherein the upper surface of second layer contacts the lower surface of the porous body, and wherein the building panel has a second NRC value as measured from the lower surface of the second layer to the upper surface of the porous body, wherein the second NRC value is at least 90% of the first NRC value.

10. The acoustic ceiling panel according to claim 7, wherein the porous body exhibits a first CAC value as measured from the lower surface to the upper surface of the porous body, and a second CAC value is measured from the second major surface to the first major surface of the building panel and the second CAC value is greater than the first CAC value.

11. The acoustic ceiling panel according to claim 1, wherein the porous body is comprised of a fibrous material and a first hydrophobic component uniformly distributed throughout the porous body.

12. The acoustic ceiling panel according to claim 11, wherein the first hydrophobic component is present in an amount of at least about 1.0 wt. % based on the total weight of the stain-repellant material.

13. An acoustic ceiling panel comprising:

a porous body having an upper surface opposite a lower surface and at least one side surface extending between the upper surface and the lower surface;

a first layer applied to the upper surface, the first layer comprising a first hydrophobic component; and a second layer applied to the lower surface, the second layer comprising a second hydrophobic component wherein the first layer further comprises a hygroscopic component.

14. The acoustic panel of claim 13, wherein the first layer is continuous and the second layer is discontinuous.

15. The acoustic ceiling panel according to claim 13, wherein the porous body is comprised of a fibrous material and a first hydrophobic component uniformly distributed throughout the porous body, wherein the first hydrophobic component is present in an amount of at least about 1.0 wt. % based on the total weight of the stain-repellant material.

* * * * *